US009127874B2

(12) United States Patent
Ye et al.

(10) Patent No.: US 9,127,874 B2
(45) Date of Patent: Sep. 8, 2015

(54) LED LAMP AND ILLUMINATION AREA HAVING SAME

(75) Inventors: Lin Ye, Ningbo (CN); Le Xu, Ningbo (CN); Xiaobo You, Ningbo (CN); Wanjiong Lin, Ningbo (CN)

(73) Assignee: Self Electronics Co., Ltd., Ningbo (CN)

( * ) Notice: Subject to any disclaimer, the term of this patent is extended or adjusted under 35 U.S.C. 154(b) by 118 days.

(21) Appl. No.: 13/978,064

(22) PCT Filed: Jul. 12, 2011

(86) PCT No.: PCT/CN2011/001151

§ 371 (c)(1), (2), (4) Date: Sep. 26, 2013

(87) PCT Pub. No.: WO2012/100391

PCT Pub. Date: Aug. 2, 2012

(65) Prior Publication Data

US 2014/0160731 A1 Jun. 12, 2014

(30) Foreign Application Priority Data

Jan. 24, 2011 (CN) ..... 2011 1 0032890

(51) Int. Cl.
*F25D 27/00* (2006.01)
*F21V 31/00* (2006.01)

(Continued)

(52) U.S. Cl.
CPC . *F25D 27/00* (2013.01); *F21K 9/17* (2013.01); *F21S 4/008* (2013.01); *F21V 15/01* (2013.01); *F21V 21/025* (2013.01); *F21V 31/005* (2013.01); *F21V 15/015* (2013.01); *F21V 19/0055* (2013.01); *F21V 23/06* (2013.01); *F21W 2131/305* (2013.01); *F21W 2131/405* (2013.01); *F21Y 2101/02* (2013.01); *F21Y 2103/003* (2013.01)

(58) Field of Classification Search
CPC ..... F21S 8/036; F21S 4/008; F21K 9/17; F21V 15/01; F21V 31/005; F21W 2131/305
USPC ..... 362/92
See application file for complete search history.

(56) References Cited

U.S. PATENT DOCUMENTS 6,325,523 B1 * 12/2001 Santosuosso et al. ..... 362/125
7,163,305 B2 * 1/2007 Bienick ..... 362/92

(Continued)

*Primary Examiner* — Anh Mai
*Assistant Examiner* — Matthew J Peerce
(74) *Attorney, Agent, or Firm* — Wang Law Firm, Inc.; Li K. Wang; Stephen Hsu

(57) ABSTRACT

A freezer lamp includes a strip lamp holder, a light module, a socket, and a plurality of decks. The light module is disposed in the strip lamp holder. The socket is disposed on the end of the strip lamp holder and electrically connected to the light module. The strip lamp holder includes a main lateral surface and a mounting lateral surface. An installation groove is formed in the main lateral surface along length direction thereof. The light module is received into the installation groove. Two clamping grooves are formed in the mounting lateral surface along length direction thereof and are spaced apart from each other. Each of the decks includes two clamping edges which are spaced apart from each other. The distance between the two clamping edges is exactly equal to that between the two clamping grooves. The clamping edge is cooperating with the corresponding buckle of the clamping groove.

10 Claims, 7 Drawing Sheets

(51) Int. Cl.

| | |
|---|---|
| ***F21S 4/00*** | (2006.01) |
| ***F21V 21/02*** | (2006.01) |
| ***F21V 15/01*** | (2006.01) |
| ***F21K 99/00*** | (2010.01) |
| *F21V 19/00* | (2006.01) |
| *F21V 23/06* | (2006.01) |
| *F21Y 101/02* | (2006.01) |
| *F21Y 103/00* | (2006.01) |
| *F21V 15/015* | (2006.01) |
| *F21W 131/305* | (2006.01) |
| *F21W 131/405* | (2006.01) |

(56) References Cited

U.S. PATENT DOCUMENTS

| | | | | |
|---|---|---|---|---|
| 8,746,916 | B2 * | 6/2014 | Oketani et al. | 362/125 |
| 2001/0048595 | A1 * | 12/2001 | Richardson | 362/92 |
| 2002/0051357 | A1 * | 5/2002 | Truttmann-Battig | 362/92 |
| 2005/0265019 | A1 * | 12/2005 | Sommers et al. | 362/217 |
| 2008/0037239 | A1 * | 2/2008 | Thomas et al. | 362/92 |
| 2008/0158858 | A1 * | 7/2008 | Madireddi et al. | 362/92 |
| 2009/0135587 | A1 * | 5/2009 | Oketani et al. | 362/125 |
| 2009/0244884 | A1 * | 10/2009 | Trulaske, Sr. | 362/94 |
| 2010/0254146 | A1 * | 10/2010 | McCanless | 362/368 |

* cited by examiner

A-A

LED LAMP AND ILLUMINATION AREA HAVING SAME

TECHNICAL FIELD

The invention relates to a lighting device, in particular, to a lighting lamp for freezer.

DESCRIPTION OF THE RELATED ART

Providing better sense for customer to choose and pick goods conveniently, present refrigerator and freezer manufacturer (especially refrigerator used in supermarket) tends to assemble corresponding light source to light the products. However, present light source in most refrigerator and freezer adopts traditional light source (e.g. incandescent lamp or fluorescent lamp) for providing illumination. When it's irradiating, there are problems including this lighting illumination of high power consumption, non-uniform illumination, shadow, and so on. In view of this situation, many manufacturers have made improvements on the present method of illumination of refrigerator and freezer, such as arranging a plurality of traditional light source in rows and columns to provide illumination. However, this method of illumination cannot fundamentally solve the problem of insufficient illumination, shadow, and so on. Moreover, it may further increase the power consumption.

In the current art, the patent such as the Chinese utility model, whose title is an unidirectional and bidirectional illuminating LED lamp for refrigerators and whose patent number is ZL200820207126.6, discloses a kind of lamp for refrigerator. The lamp includes LED light source, housing and holder. The housing includes a light transmission unit and a light emitting unit. The light transmission unit has an external surface and an internal surface that both have smooth arc shape. The light emitting unit has an external surface and an internal surface. The external surface of the light emitting unit has a smooth arc shape and the internal surface has a plurality of light reflections troughs formed thereon. The lamp is characterized with low power consumption, high efficiency, and long lifetime as it adopts LED as light source for illuminating, and the lamp makes use of the most of principles of transmission, refraction and reflection to distribute the light emitted from the LED light source to a wide range to avoid shadows and inadequate illumination appearing in the process of illuminating the cavity of freezer or refrigerator. However, it is difficult to install the above lamp as a lamp holder of the lamp is directly fixed to the mounting surface of the freezer that cannot assemble and disassemble immediately. And, only when the mounting surface is perfectly corresponding to the lamp holder contact surface, the lamp can ensure steady thereof. In addition, the lamp has not any waterproof sealing structure. When the lamp is used for a long time in the freezer, it is easy to be damaged which greatly shortens the lifetime thereof. Since the lamp is used in freezer whose internal environment in which humidity and water vapor exist because of temperature change, is different from the dry environment of conventional lamps.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

Figure 1:
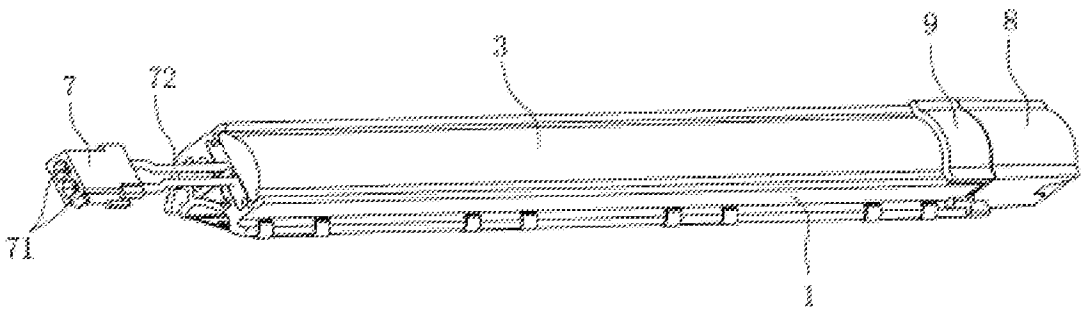
FIG. 1 illustrates an isometric view of one embodiment according to the present invention.
Figure 2:
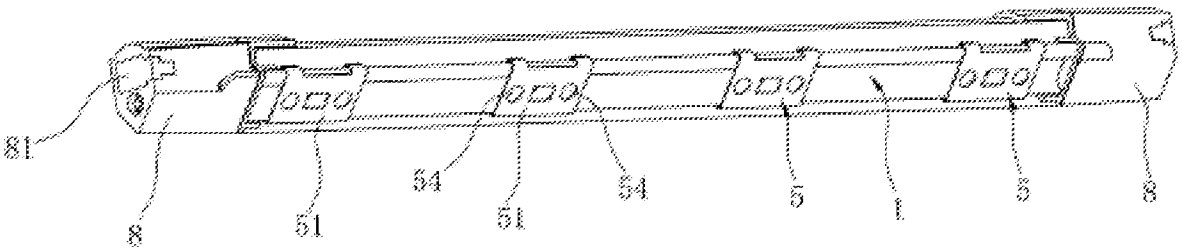
FIG. 2 illustrates an isometric view of another embodiment according to the present invention.
Figure 3:
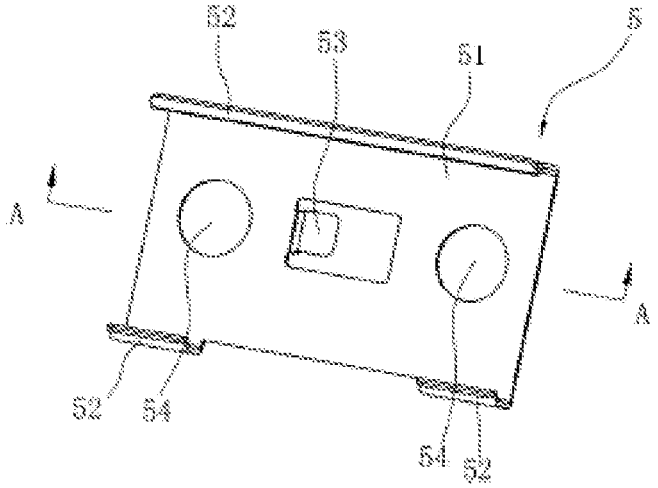
FIG. 3 illustrates an isometric view of a deck of the embodiment according to the present invention.
Figure 4:
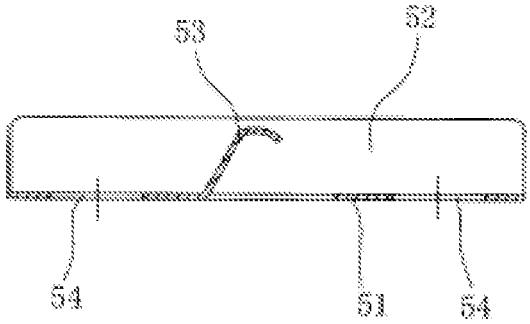
FIG. 4 illustrates a cross-sectional view of FIG. 3 taken along the line of A-A.

The disclosure is illustrated by way of example and not by way of limitation in the figures of the accompanying drawings. It should be noted that references to "an" or "one" embodiment in this disclosure are not necessarily to the same embodiment, and such references mean at least one.

A freezer lamp according to the embodiment of the present invention is shown from FIG. 1 to FIG. 7. The freezer lamp includes a strip lamp holder 1, a light module and two sockets 7 configured for connecting to an external power supply.

Wherein, the light module includes a printed circuit board 2 and a plurality of LED chips 21 electrically arranged on the printed circuit board 2. The socket 7 is electrically connected with the printed circuit board 2. A strip condensing lens 3 is arranged at front of the printed circuit board 2. The cross-section of the strip condensing lens 3 may have a shape of approximate semicircular. Two lateral portions with certain width are formed at two side of the condensing lens 3 along length direction thereof.

The strip lamp holder 1 includes a main lateral surface 11 and a mounting lateral surface 12. An installation groove 111 is formed on the main lateral surface 11 along length direction thereof. The cross-section of the installation groove 111 likes U-shape, and two bulgy strips 112 are respectively formed on the two lateral wall of the installation groove 111 along length direction thereof Each of the bulgy strips 112 divides the lateral wall of the installation groove 111 into an upper lateral surface a and a lower lateral surface b. A flat groove 113 is formed among the bulgy strip 112, the lower lateral surface b of the installation groove 111 and the bottom of the installation groove 111. The printed circuit board 2 is disposed onto the flat groove 113, and is firmly fixed on the strip lamp holder 1 by screws 22. An L-shape clamping portion is formed between the bulgy strip 112 and the upper lateral surface a of the installation groove 111. A C-shape seal groove cavity 114 is formed in the clamping portion along length direction thereof. The seal groove cavity 114 has same size with a sealing strip 4. The lower portion of two lateral sides of the condensing lens 3 touches against a portion of the sealing strip 4 which exposes out of the seal groove cavity 114. A plurality of protrudes a1 are formed on the top of the upper lateral wall a of the installation groove 111, and the upper portion of two lateral sides of the condensing lens 3 are limited under the protrudes a1.

An inclined angle β is formed on the mounting lateral surface 12 with respect to the main lateral surface 11, the angular value of the inclined angle β is predetermined according to the specific output angle of the freezer lamp. As the preferred, the included angle β can be selected as 45 degrees. In this condition, when the freezer lamp is assembled along vertical direction, the freezer lamp would illuminate the center of freezer which results in a better output angle.

Figure 5:
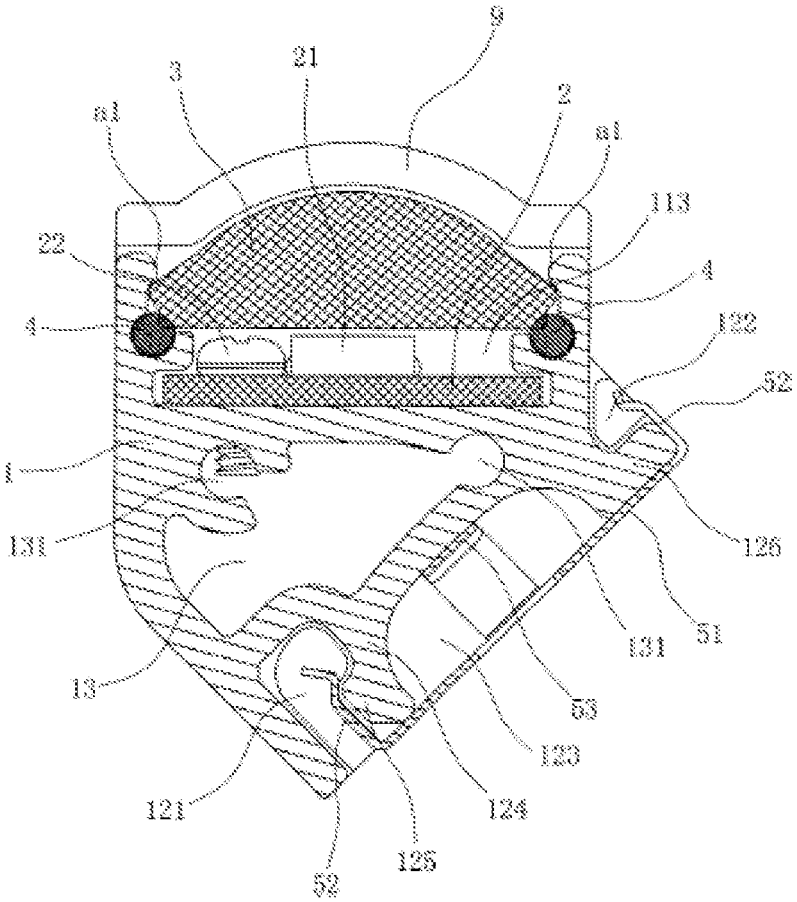
FIG. 5 illustrates a cross-sectional view of the freezer lamp of the present invention.
Figure 6:
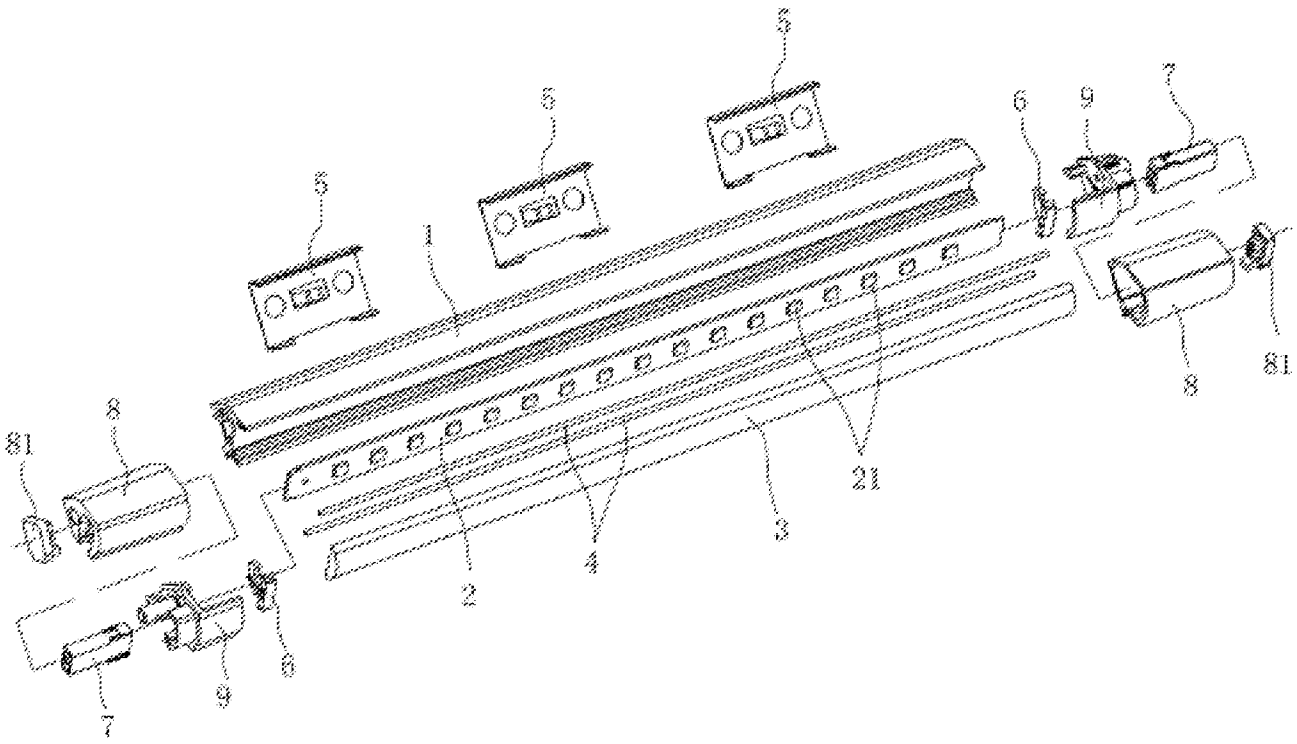
FIG. 6 illustrates an exploded isometric view of the freezer lamp of the present invention.
Figure 7:
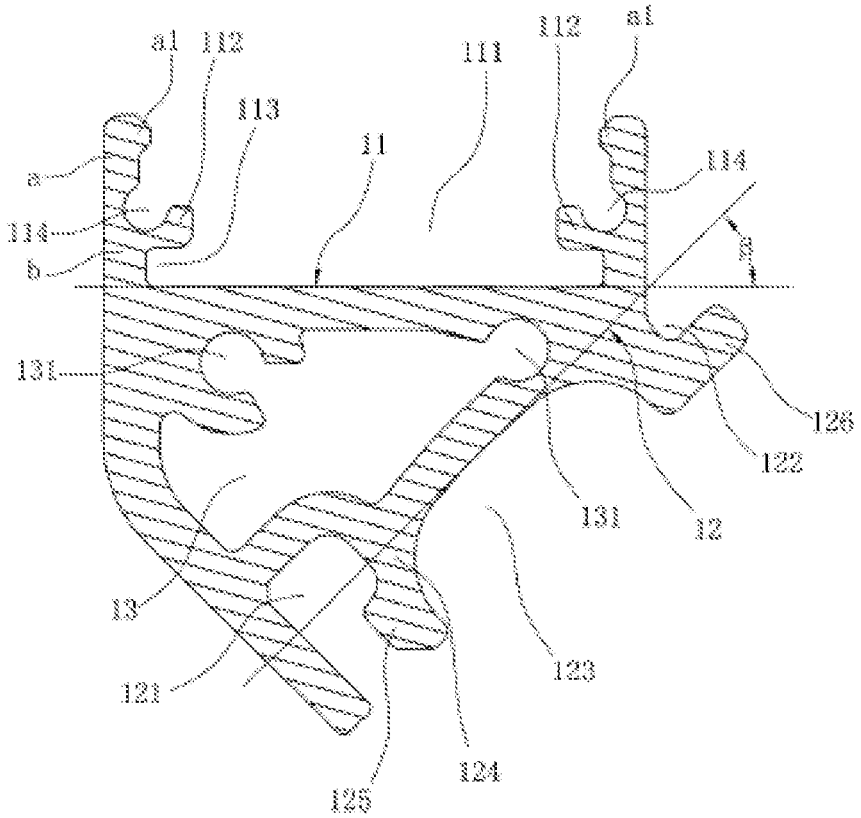
FIG. 7 illustrates a cross-sectional view of a strip lamp holder according to the embodiment of the present invention.

Two clamping grooves are formed in the mounting lateral surface 12 along length direction thereof and are spaced apart from each other. The two clamping grooves include a first clamping groove 121 and a second clamping groove 122. A convex groove 123 is opened between the first clamping groove 121 and the second clamping groove 122 along length direction thereof. An exit of the first clamping groove 121 is opened along a direction which is perpendicular to the mounting lateral surface 12. A first blocking portion 124 is formed between the first clamping groove 121 and the convex groove 123. A clamping part 125 is formed in the first blocking portion 124 along length direction thereof. An exit of the second clamping groove 122 is opened along a direction which is parallel to the mounting lateral surface 12. A second blocking portion 126 is formed between the second clamping groove 122 and the convex groove 123 and is parallel to the mounting lateral surface 12. The wall between the second blocking portion 126 and the convex groove 123 has an L-typed section. In order to assemble and disassemble the freezer lamp conveniently, pluralities of decks 5 are disposed on the mounting lateral surface 12. Each of the decks 5 includes a main body 51 and two clamping edges 52 perpendicular to the main body 51 and spaced apart from each other. The main body 51 of the decks 5 is firmly fixed onto the freezer. A leaf spring 53 is formed on the main body 51 and tilts outward of the main body 51. The leaf spring 53 can touch onto the bottom of the convex groove 123. The cross-section of leaf spring 53 has a reverse J-shaped. Two through holes 54 are opened on the main body 51 and configured for crossing through the fastener so as to fix the decks 5 onto the freezer. In the present embodiment, the fastener is screw. The screw is fixed on the freezer after crossing through the through hole 54 such that the decks 5 can be fixedly connected to a mounting surface of the freezer. The distance between the two clamping edges 52 is exactly equal to that between the first and second clamping grooves 121, 122 so that the two clamping edges 52 can be buttoned respectively into the first clamping groove 121 and the second clamping groove 122. Specifically, as shown in FIG. 5, one of the clamping edges 52 is buttoned into the first clamping groove 121 and is limited on the clamping part 125 of the first blocking portion 124, and the other is buttoned into the second clamping groove 122 and is limited onto the second blocking portion 126.

Thus, when assembling the strip lamp holder 1 of the present embodiment, it's not assembled directly onto the mounting surface of the freezer. The decks 5 are fixed on mounting surface firstly, and then, the strip lamp holder 1 is buttoned into the decks 5. As a result, assembly and disassembly of the strip lamp holder 1 is simpler and more convenient. In addition, the decks 5 have small size and occupy small space to assemble in fact. Therefore, operation becomes easier. Moreover, the surface of the strip lamp holder 1 does not directly contact the mounting surface of the freezer so as to protect the surface of the strip lamp holder 1 from being damaged, which elongates lifetime of the strip lamp holder 1.

In order to lighten weight of the freezer lamp and save material, the strip lamp holder 1 is hollow. That is to say that a cavity 13 with special-shaped structure is opened in the middle portion of the strip lamp holder 1 along length direction thereof. Two sealing plugs 6 are respectively inserted into two ends of the strip lamp holder 1 so as to avoid moisture permeating thereinto for ensuring tightness thereof. The sealing plug 6 has same shape and size with the section of the cavity 13. A tap-type hole 131 is formed on the cavity 13 along length direction thereof at two ends of holder 1. Two end caps 9 are respectively disposed on two ends of the strip lamp holder 1. A mounting hole (not shown) is opened in the end cap 9 in response to the tap-typed hole 131. The end caps 9 are fixed on the strip lamp holder 1 by screw which crosses through the mounting hole and the tap-typed hole 131.

In order to electrically connect the freezer lamp to the power supply conveniently, two sockets 7 are respectively formed at two ends of the strip lamp holder 1. A plug connector is disposed on one end of each of the sockets 7 for electrically connecting external power supply. A wire 72 is disposed on the other end of each of the sockets 7 for electrically connecting the printed circuit board 2. The freezer lamp further includes two protection suits 8 and the sockets 7 are inserted into the protection suits 8 respectively. An assembly open (not labeled) is opened in the protection suits 8 and a sealed cap 81, which has same size and shape with the assembly open, is plug into the assembly open. The protection suits 8 are connected to the end caps 9 respectively via screws so as to assemble or disassemble conveniently. An aperture is formed in each of the end caps 9 for disposing the wire 72 of the socket 7. The wire 72 of the socket 7 is electrically connected to the printed circuit board 2.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A freezer lamp, comprising:

a strip lamp holder, a light module and two sockets connected to an external power supply, the light module disposed in the strip lamp holder, the sockets disposed at the end portion of the strip lamp holder and electrically connected to the light module, wherein the strip lamp holder comprises a main lateral surface and a mounting lateral surface, an installation groove is formed in the main lateral surface along length direction thereof, the light module is received in the installation groove; and two clamping grooves are formed in the mounting lateral surface along length direction thereof and are spaced apart from each other, a plurality of decks are formed in the mounting lateral surface, the decks comprise a main body and two clamping edges which are perpendicular to two lateral sides of the main body respectively, the main body is fixed on a freezer, the distance between the two clamping edges is exactly equal to that between the two clamping grooves, the clamping edge is buckled into the clamping groove, a convex groove is formed in the mounting lateral surface along length direction thereof and located between the two clamping grooves, a leaf spring is formed on the main body of the deck and tilts outwards and touches onto the bottom of the convex groove.

2. The freezer lamp of claim 1, wherein two through holes are opened respectively at two lateral surfaces of the leaf spring for disposing a fastener of the freezer lamp.

3. The freezer lamp of claim 1, wherein the two clamping grooves comprise a first clamping groove and a second clamping groove, the first clamping groove is perpendicular to the mounting lateral surface, a first blocking portion is formed between the first clamping groove and the convex groove, a clamping part is formed in the first blocking portion along length direction thereof, one clamping edge of the deck is buttoned directly into the clamping part; the second clamping groove is opened in parallel to the mounting lateral surface, a second blocking portion is formed between the second clamping groove and the convex groove and is parallel to the mounting lateral surface, and a side wall formed between the second blocking portion and the convex groove has an L-shaped section, another clamping edge of the deck is buttoned directly into the second blocking portion.

4. The freezer lamp of claim 1, wherein the light module comprises a printed circuit board disposed on the installation groove and a plurality of LED chips electrically connected to the printed circuit board, the socket is electrically connected with the printed circuit board, and a strip condensing lens is disposed on the installation groove and is disposed on the front of the printed circuit board.

5. The freezer lamp of claim 4, wherein the cross-section of the installation groove has a U-typed shape, two bulgy strips are respectively formed in the two lateral walls of the installation groove along length direction thereof, each of the bulgy strips divides the lateral wall of the installation groove into an upper lateral wall (a) and an lower lateral wall (b), a flat groove is formed among the bulgy strips, the lower lateral wall (b) of the installation groove and the bottom of the installation groove, the printed circuit board is inserted into the flat groove.

6. The freezer lamp of claim 5, wherein a clamping portion is formed between the bulgy strips and the upper lateral wall of the installation groove, a seal groove cavity is opened in the clamping portion along length direction thereof, a seal strip is inserted into the seal groove cavity and has same size with the seal groove cavity, at least one protrude is formed on the top of the upper lateral wall of the installation groove, the upper portion of two lateral sides of condensing lens is restrictedly disposed under the protrude, the lower portion of two lateral sides of the condensing lens is located between the bottom of the protrudes and top of the seal strips.

7. The freezer lamp of claim 1, wherein a cavity is opened in the center of the strip lamp holder along length direction thereof, two sealing plugs are disposed on two ends of the strip lamp holder respectively and have same shape and size with the cavity.

8. The freezer lamp of claim 7, wherein the sockets are disposed on both ends of the strip lamp holder, the sockets are inserted into two protective suits respectively, two end caps are disposed onto both ends of the strip lamp holder respectively, the protective suits are fixedly connected to the end caps, an aperture is opened in the end cap for crossing through a wire therefrom.

9. The freezer lamp of claim 8, wherein a tap-typed hole is formed in the inner surface of the cavity along length direction thereof, and an assembling hole is opened in the end caps and is aligned with the tap-typed hole, the end cap is fixedly connected to the strip lamp holder via screw which crosses through the assembling hole and the tap-typed hole.

10. The freezer lamp of claim 9, wherein an assembly opening is opened in the end of the protective suit for said socket plugging therein, the assembling opening is connected to a sealed cap which has same shape and size with the assembling opening.

* * * * *